US006290511B1

(12) United States Patent
Edwards et al.

(10) Patent No.: US 6,290,511 B1
(45) Date of Patent: Sep. 18, 2001

(54) GROUNDING OF SNAP SWITCHES IN A WIRING BOX

(76) Inventors: Michael G. Edwards, 1980 Freedom La., Hudson, NC (US) 28638; Robert E. Blair, 710 Wooddale Pl., Lenior, NC (US) 28656

( * ) Notice: Subject to any disclaimer, the term of this patent is extended or adjusted under 35 U.S.C. 154(b) by 0 days.

(21) Appl. No.: 09/358,048

(22) Filed: Jul. 21, 1999

(51) Int. Cl.[7] ..... H01R 4/66
(52) U.S. Cl. ..... 439/95; 439/624; 200/51 R
(58) Field of Search ..... 439/95, 97, 107, 439/502, 505, 624; 200/559, 51 R

(56) References Cited

U.S. PATENT DOCUMENTS 4,245,880 * 1/1981 Zimmerman, Jr. et al. .
5,630,502 * 5/1997 Kurek et al. ..... 200/559
5,826,710 * 10/1998 Kurek et al. ..... 200/559

* cited by examiner

*Primary Examiner*—Khiem Nguyen
(74) *Attorney, Agent, or Firm*—Kennedy Covington Lobdell & Hickman, LLP

(57) ABSTRACT

A method for grounding a plurality of snap switches arranged in a wiring box to a common ground source includes: connecting together in series the equipment grounding terminal of each snap switch with sheathed connecting wires such that each equipment grounding terminal of each snap switch is disposed in electrical communication only with the equipment grounding terminal of each other snap switch, the electrical communication forming an electrical network; and, connecting with a sheathed lead grounding wire the electrical network to a common ground source of the wiring box such that each snap switch is grounded. An electrical switch apparatus of the present invention includes a wiring box and plurality of snap switches mounted to the wiring box. Each snap switch includes an equipment grounding terminal. The electrical switch apparatus also includes a plurality of sheathed connecting wires. The equipment grounding terminal of each snap switch is connected by at least one sheathed connecting wire to an equipment grounding terminal of another snap switch such that all said equipment grounding terminals of the snap switches are disposed in electrical connection in series only with each other through the sheathed connecting wires. The apparatus also includes a single sheathed lead grounding wire connecting the equipment grounding terminal of one snap switch to a common ground source to ground all of the snap switches.

13 Claims, 6 Drawing Sheets

GROUNDING OF SNAP SWITCHES IN A WIRING BOX

FIELD OF THE PRESENT INVENTION

The present invention relates to the grounding of a plurality of electrical switches commonly used for controlling lighting in buildings.

BACKGROUND OF THE PRESENT INVENTION

Snap switches, including dimmer switches, are commonly used for controlling lighting in buildings. When more than one snap switch is provided at a particular location, the plurality of snap switches are mounted on a wiring box disposed in a wall and covered by a faceplate attached to the wiring box.

Section 380-9(b) of the revised National Electrical Code currently requires that each snap switch be grounded. This section additionally requires that each snap switch provide a means for grounding a metal faceplate of the wiring box. According to this section, a snap switch is considered to be effectively grounded if the snap switch is mounted with metal screws to a metal box or to a non-metallic box having integral means for grounding devices. Alternatively, the snap switch is considered to be effectively grounded if an equipment grounding conductor or equipment bonding jumper is connected to an equipment grounding terminal of the snap switch.

To comply with the revised code when installing snap switches in a non-metallic wiring box, the current industry practice is to connect the equipment grounding terminal of each snap switch to a common ground of the wiring box using an exposed solid copper wire. The common ground typically comprises a wiring nut to which each ground wire leading into the wiring box is connected.

A drawback to this current practice for grounding snap switches is that the possibility exists that an exposed solid copper wire leading from a snap switch to the grounding nut may inadvertently contact an unsheathed portion of a hot wire or a mounting screw of the hot wire, thereby resulting in a short circuit. The risk of a short circuit occurs when the snap switch is installed in or withdrawn from a wiring box, especially since the stiffness of the solid copper wire makes it difficult to manipulate for avoiding a short circuit. Furthermore, this risk significantly increases as the number of snap switches installed in the wiring box increases.

A need therefore exists for a better method of grounding snap switches in a wiring box which minimizes the risk of a short circuit.

SUMMARY OF THE PRESENT INVENTION

Briefly, the present invention includes a method for grounding a plurality of snap switches arranged in a wiring box to a common ground source including the steps of: connecting together the grounding terminal of each snap switch of the plurality of snap switches with sheathed connecting wires such that each grounding terminal of each snap switch of the plurality of snap switches is disposed in electrical communication only with the grounding terminal of each other snap switch of the plurality of snap switches, the electrical communication forming an electrical network; and, connecting with a sheathed lead grounding wire the electrical network to a common ground source of the wiring box such that each snap switch is grounded.

In a feature of the method of the present invention, the sheathed lead grounding wire is connected to a grounding terminal of a snap switch of the plurality of snap switches. In other features, the electrical network is connected to the ground source only by the sheathed lead grounding wire, and the grounding terminals of the snap switches are connected in series in the electrical network by the sheathed connecting wires.

The present invention also includes an electrical conducting apparatus for grounding a plurality of snap switches to a common ground source and an electrical switch apparatus in which a plurality of snap switches are grounded to a common ground source.

The electrical conducting apparatus includes a plurality of sheathed connecting wires. Each end of each sheathed connecting wire is retained within a crimped spade lug such that all sheathed connecting wires are disposed in electrical communication with one another. The plurality of sheathed connecting wires thereby form an electrical network. Each crimped spade lug is configured for attachment to a grounding terminal of a snap switch.

In the electrical conducting apparatus, at least one crimped spade lug includes not only the end of a single sheathed connecting wire retained therein, but also an end of a sheathed lead grounding wire, the sheathed lead grounding wire thereby being disposed in electrical communication with each of the sheathed connecting wires through the electrical network. The sheathed lead grounding wire includes an opposite end that is left unattached for later connection thereof to a common ground source, whereby the connecting wires are each grounded through the electrical network. In a feature of the electrical conducting apparatus, the crimped spade lugs are disposed in series relative to one another in the electrical network.

The electrical switch apparatus includes a wiring box and plurality of snap switches mounted to the wiring box. Furthermore, each snap switch includes a grounding terminal. The electrical switch apparatus also includes a plurality of sheathed connecting wires. The grounding terminal of each snap switch is connected by at least one sheathed connecting wire to a grounding terminal of another snap switch such that all grounding terminals of the snap switches are disposed in electrical connection with each other through the sheathed connecting wires. The apparatus also includes a sheathed lead grounding wire connecting the grounding terminal of one of the plurality of snap switches to a common ground source such that each snap switch of the electrical switch apparatus is grounded. Preferably, the common ground source comprises a wire nut to which at least one ground wire of a feed line leading into the wiring box is connected.

In a feature of the electrical switch apparatus, the grounding terminal of only one of the snap switches is connected to the common ground source by the sheathed lead grounding wire. In a further feature, the grounding terminals are connected by the sheathed connecting wires in series with each other.

BRIEF DESCRIPTION OF THE FIGURES

A preferred embodiment of the present invention will now be described in detail with reference to the Figures, wherein.

DETAILED DESCRIPTION OF A PREFERRED EMBODIMENT

Figure 1:
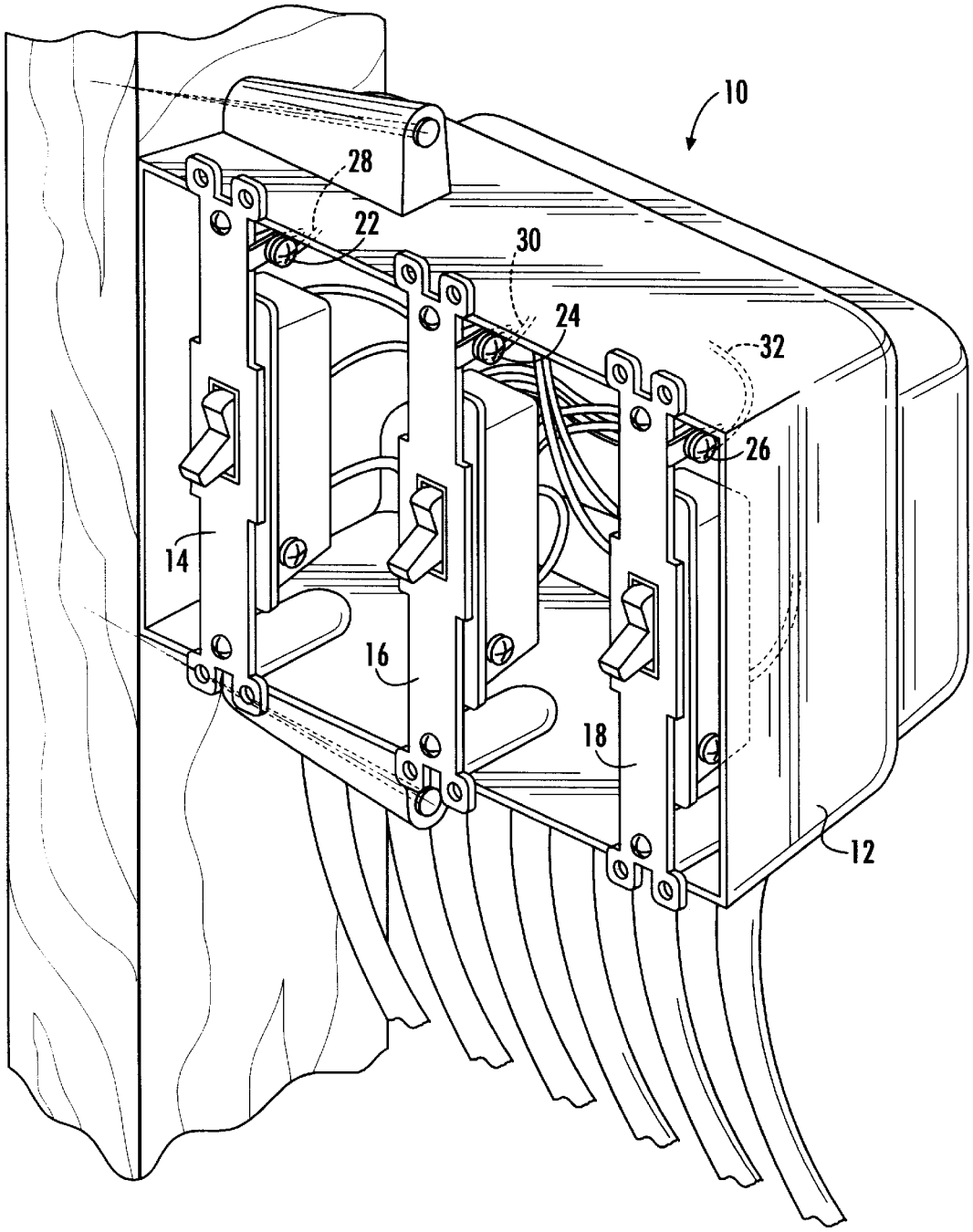
FIG. 1. (PRIOR ART)
FIG. 1 is a perspective view of a conventional electrical switch apparatus having three snap switches installed within the wiring box thereof.
Figure 2:
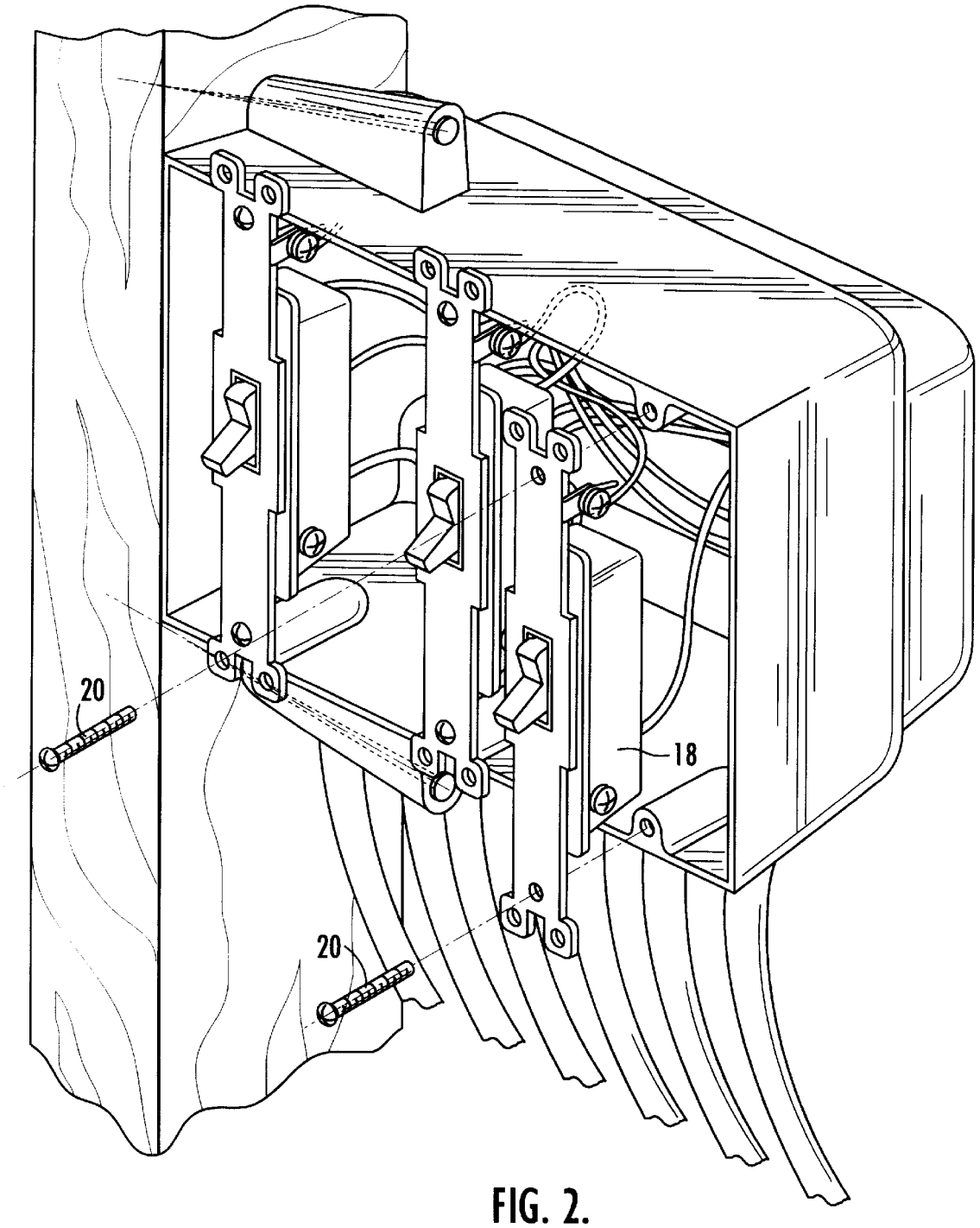
FIG. 2. (PRIOR ART)
FIG. 2 is a perspective view of the withdrawal of a snap switch from the wiring box of FIG. 1.

A conventional electrical switch apparatus 10 shown in FIG. 1 includes a wiring box 12 having three snap switches 14, 16, 18 installed therein. Each snap switch is installed within the wiring box 12 via conventional screws 20. In FIG. 2 the screws 20 of a single snap switch 18 have been removed and the snap switch 18 withdrawn from the wiring box 12 for an inspection of the electrical switch apparatus 10. The electrical circuits of the electrical switch apparatus 10 are schematically shown in FIG. 3.

Each snap switch 14,16,18 is conventionally grounded by connecting a grounding terminal 22,24,26 of each snap switch 14,16,18 to a common ground of the wiring box 12 using exposed solid copper wiring 28,30,32. The copper wire 28,30,32 is extremely stiff and is not easily manipulated. Consequently, upon withdrawing and reinstalling a snap switch 14, 16, 18, the copper wire 28,30,32 often comes into contact with either an exposed portion of a hot wire or a terminal screw of a hot connection of a snap switch 14,16,18, thereby causing a short circuit.

Figure 3:
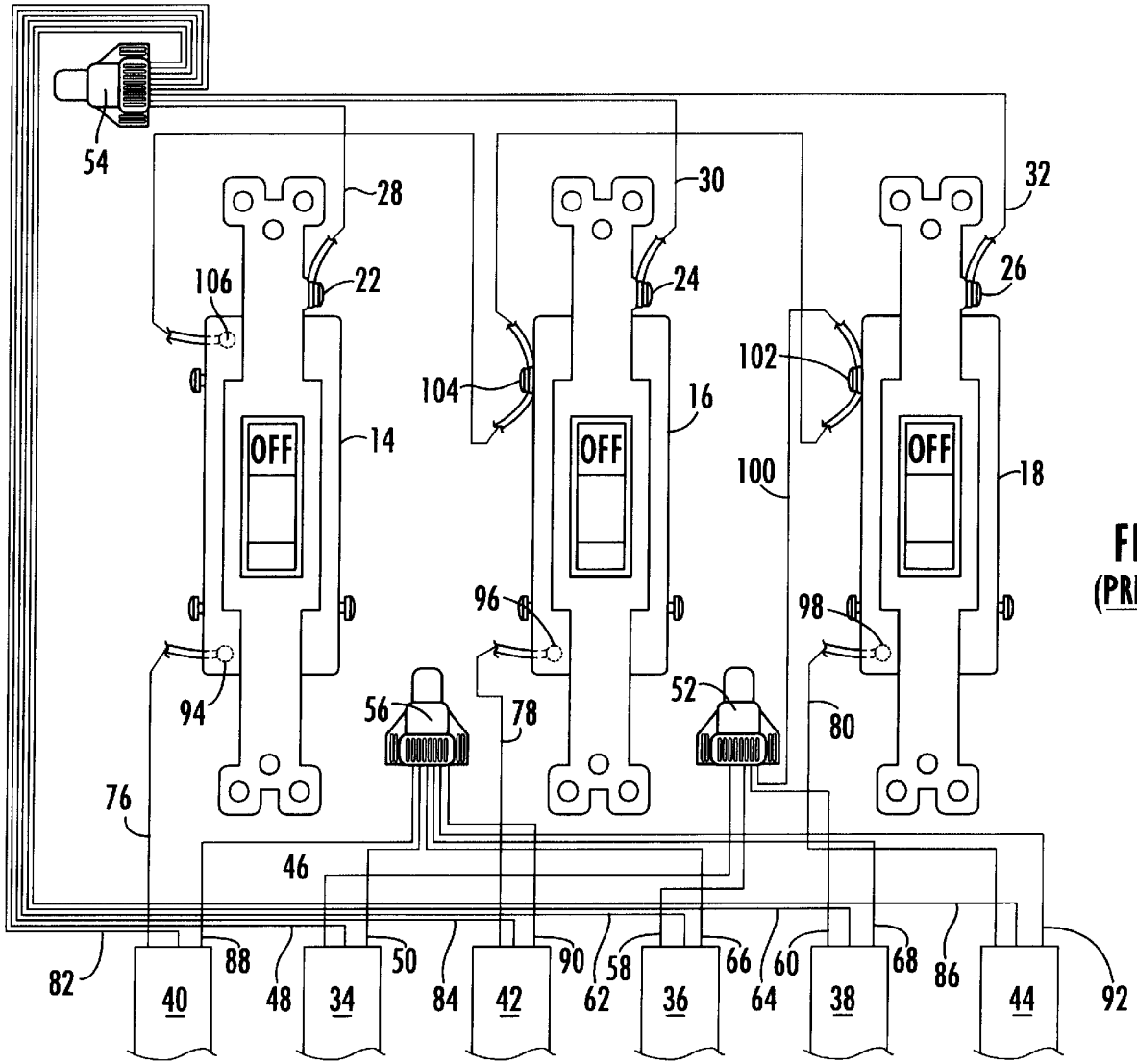
FIG. 3. (PRIOR ART)
FIG. 3 is a schematic illustration of the electrical circuits of the electrical switch apparatus of FIG. 1.

With particular reference to FIG. 3, the electrical switch apparatus 10 includes a feed line 34 leading into the wiring box 12, two receptacle feed lines 36,38 leading out of the wiring box 12, and three switch legs 40,42,44 leading out of the wiring box 12. The feed line 34 extends from an electrical panel of the building (not shown) and is the source of electricity for the electrical switch apparatus 10.

The feed line 34 includes a hot wire 46, a ground wire 48, and a neutral wire 50. The hot wire 46 leads to a feed wire nut 52, the ground wire 48 leads to a ground wire nut 54 representing the common ground for the electrical switch apparatus 10, and the neutral wire 50 leads to a neutral wire nut 56.

Each receptacle feed line 36,38 also respectively includes a hot wire 58,60, a ground wire 62,64, and a neutral wire 66,68. The hot wires 58,60 lead to the feed wire nut 52, the ground wires 62,64 lead to the ground wire nut 54, and the neutral wires 66,68 lead to the neutral wire nut 56. Each receptacle feed line 36,38 represents an extension of the feed line 34, bypassing the snap switches 14,16,18 of the electrical switch apparatus 10 and lead to receptacles disposed in walls of the building (not shown).

In addition to the feed line 34 and receptacle feed lines 36,38, the electrical switch apparatus also includes three switch legs 40,42,44 leading into the wiring box 12.

Each switch leg 40,42,44 of the wiring box 12 leads to a light or other electrical load (not shown), and respectively includes a hot wire 76,78,80, a ground wire 82,84,86, and a neutral wire 88,90,92. As in the feed wire 34 and the receptacle lead wires 36,38, each ground wire 82,84,86 leads to the ground wire nut 54 and each neutral wire 88,90,92 leads to the neutral wire nut 56. However, unlike the feed wire 34 and the receptacle feed wires 36,38, each hot wire 76,78,80 leads to a respective first switch terminal 94,96,98 of each snap switch 14,16,18.

A sheathed lead wire 100 extends from the feed wire nut 52 to each of second switch terminals 102, 104, 106 of the snap switches 14,16,18. In particular, the sheathed lead wire 100 extends to each of the second switch terminals 102,104, 106 of each snap switch 14,16,18. Exposed portions (not shown) of the sheathed lead wire 100 each respectively wraps around second switch terminal 102,104 of snap switches 16,18, and an end of the sheathed lead wire 100 is retained in electrical connection with second switch terminal 106 of snap switch 14, whereby each second switch terminal is disposed in electrical communication with one another.

With this wiring arrangement, selective disposition of the switch of each respective snap switch 14,16,18 connects the first and second switch terminals thereof together and thereby completes an electrical circuit. The completion of the electric circuit, in turn, drives the light or other electrical load connected to the particular switch leg 40,42,44 of the respective snap switch 14,16,18.

In accordance with the electrical code, and as set forth above, each snap switch 14,16,18 of the electrical switch apparatus 10 is grounded to the ground wire nut 54 respectively by unsheathed solid copper wires 28,30,32 each extending from the ground wire nut 54 to respective grounding terminals 22,24,26 of snap switches 14,16,18. The unsheathed solid copper wire is very stiff and difficult to manipulate, and upon withdrawing and reinstalling a snap switch as shown in FIG. 2, the exposed copper wires are prone to contacting second switch terminals of the snap switches or exposed portions of a hot wire thus resulting in a short circuit.

Figure 4:
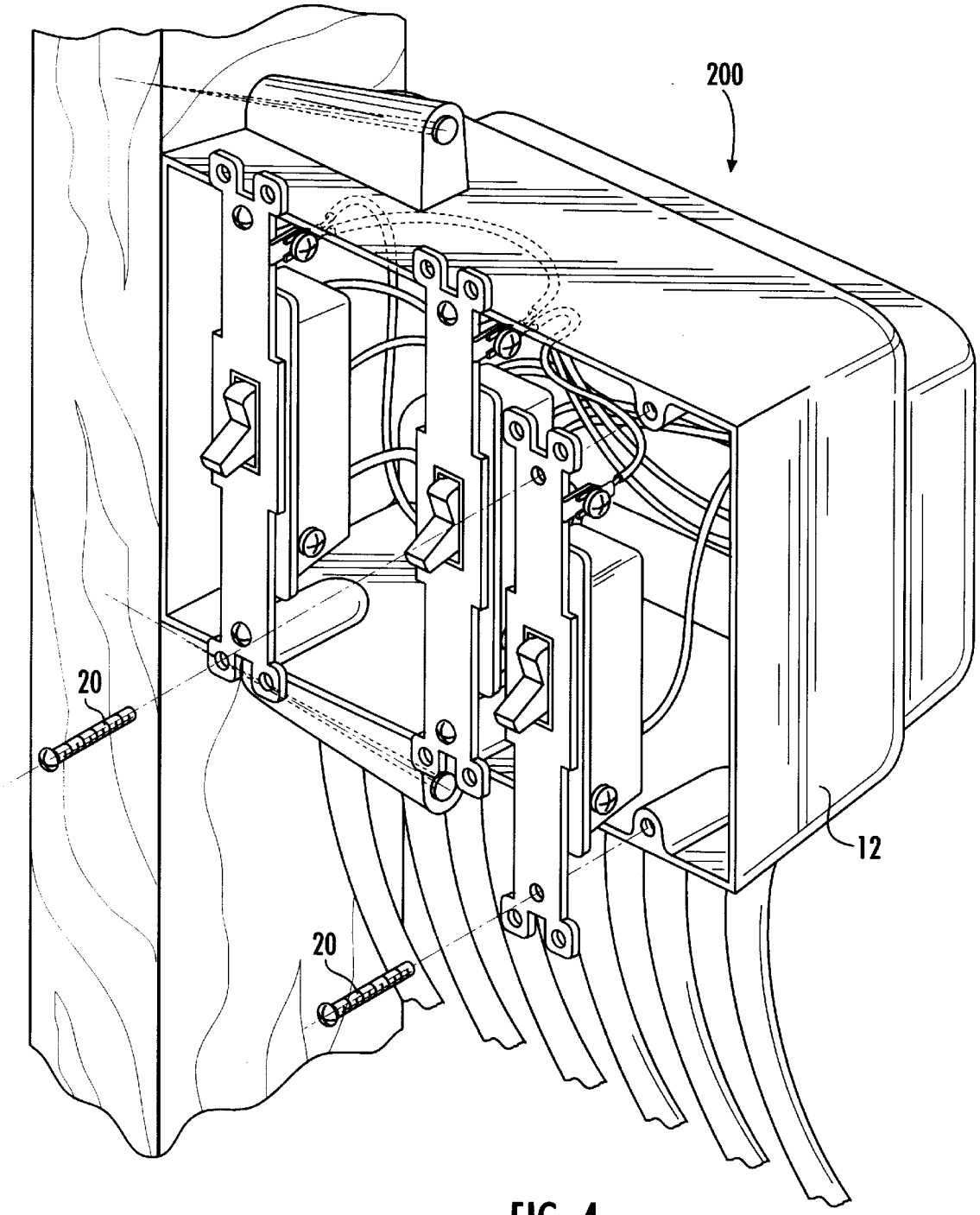
FIG. 4 is a perspective view of the withdrawal of a snap switch from a wiring box of an electrical switch apparatus in accordance with the present invention.
Figure 5:
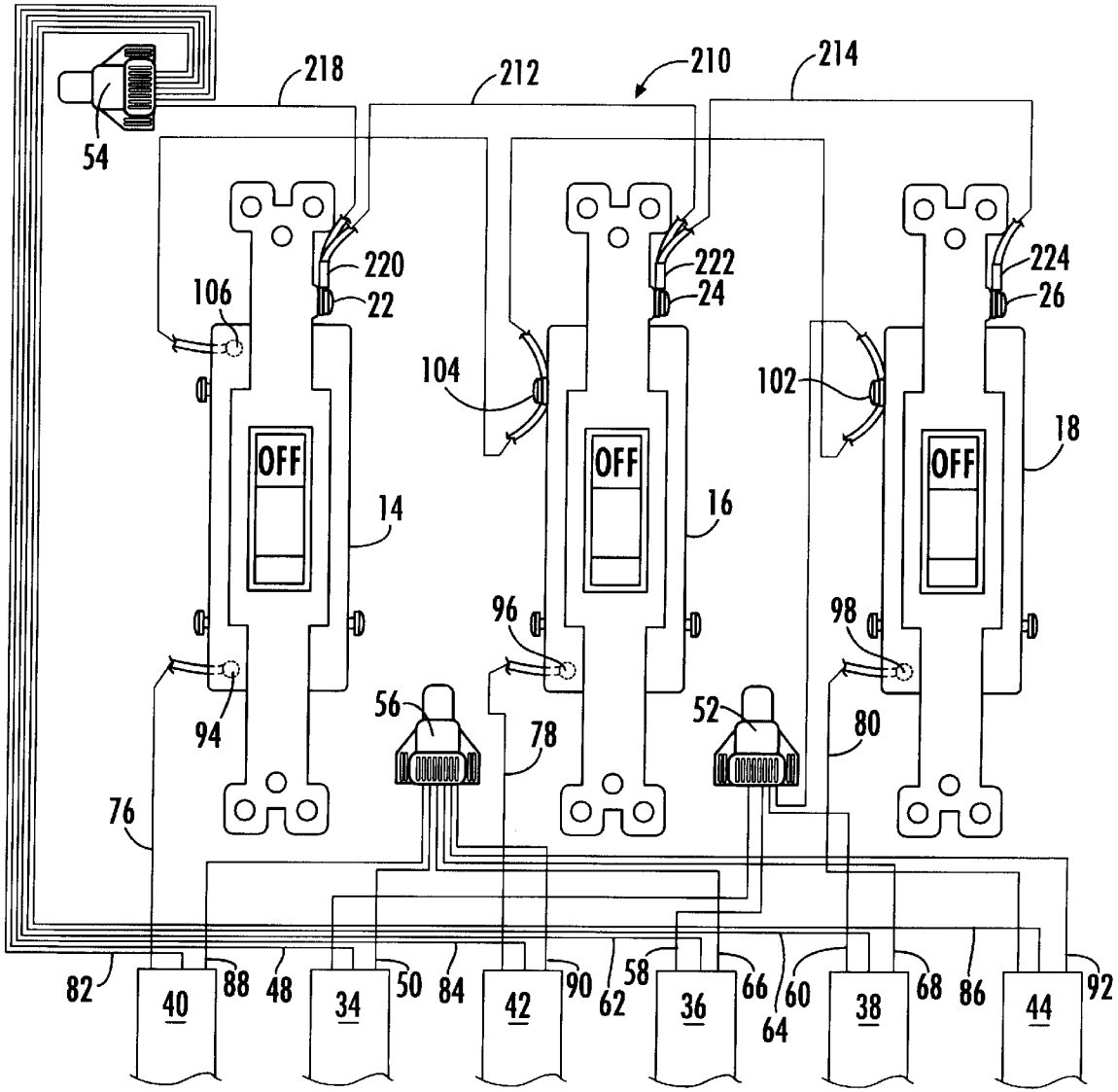
FIG. 5 is a schematic illustration of the electrical circuits of the electrical switch apparatus of FIG. 4.

In the electrical switch apparatus 200 of the present invention shown in FIG. 4, the risk of a short circuit is minimized. The electrical circuits thereof are schematically shown in FIG. 5 and for ease of understanding, elements that are identical between the electrical switch apparatus 200 of the present invention and the electrical switch apparatus 10 of FIGS. 1–3 will be referred to with like reference numbers.

As in the conventional electrical switch apparatus 10, the electrical switch apparatus 200 of the present invention includes a feed line 34 leading into the wiring box 12, two receptacle feed lines 36,38 leading out of the wiring box 12, and three switch legs 40,42,44 leading out of the wiring box 12. The feed line 34 extends from an electrical panel of the building and is the source of electricity for the wiring box 12.

The feed line 34 includes a hot wire 46, a ground wire 48, and a neutral wire 50. The hot wire 46 leads to a feed wire nut 52, the ground wire 48 leads to a ground wire nut 54 representing the common ground for the wiring box 12, and the neutral wire 50 leads to a neutral wire nut 56.

Each receptacle feed line 36,38 also includes a respective hot wire 58,60, a ground wire 62,64, and a neutral wire 66,68. Each hot wire 58,60 leads to the feed wire nut 52, each ground wire 62,64 leads to the ground wire nut 54, and each neutral wire 66,68 leads to the neutral wire nut 56.

Each switch leg 40,42,44 of the electrical switch apparatus 200 leads to a light or other electrical load (not shown), and respectively includes a hot wire 76,78,80, a ground wire 82,84,86, and a neutral wire 88,90,92. As in the feed line 34 and the receptacle feed lines 36,38, each ground wire 82,84,86 leads to the ground wire nut 54 and each neutral wire 88,90,92 leads to the neutral wire nut 56. Each hot wire 76,78,80 of each switch leg 40,42,44 leads to a first switched terminal 94,96,98 of each snap switch 14,16,18, respectively.

In contrast to the conventional electrical switch apparatus 10, the electrical switch apparatus 200 in accordance with the present invention includes a novel electrical conducting apparatus 210 which links the grounding terminals 22,24,26 of the snap switches 14,16,18 into electrical communication with one another and to the common ground of the wiring box 12 while minimizing the risk of causing a short circuit during withdrawal and insertion of a snap switch 14,16,18.

Figure 6:
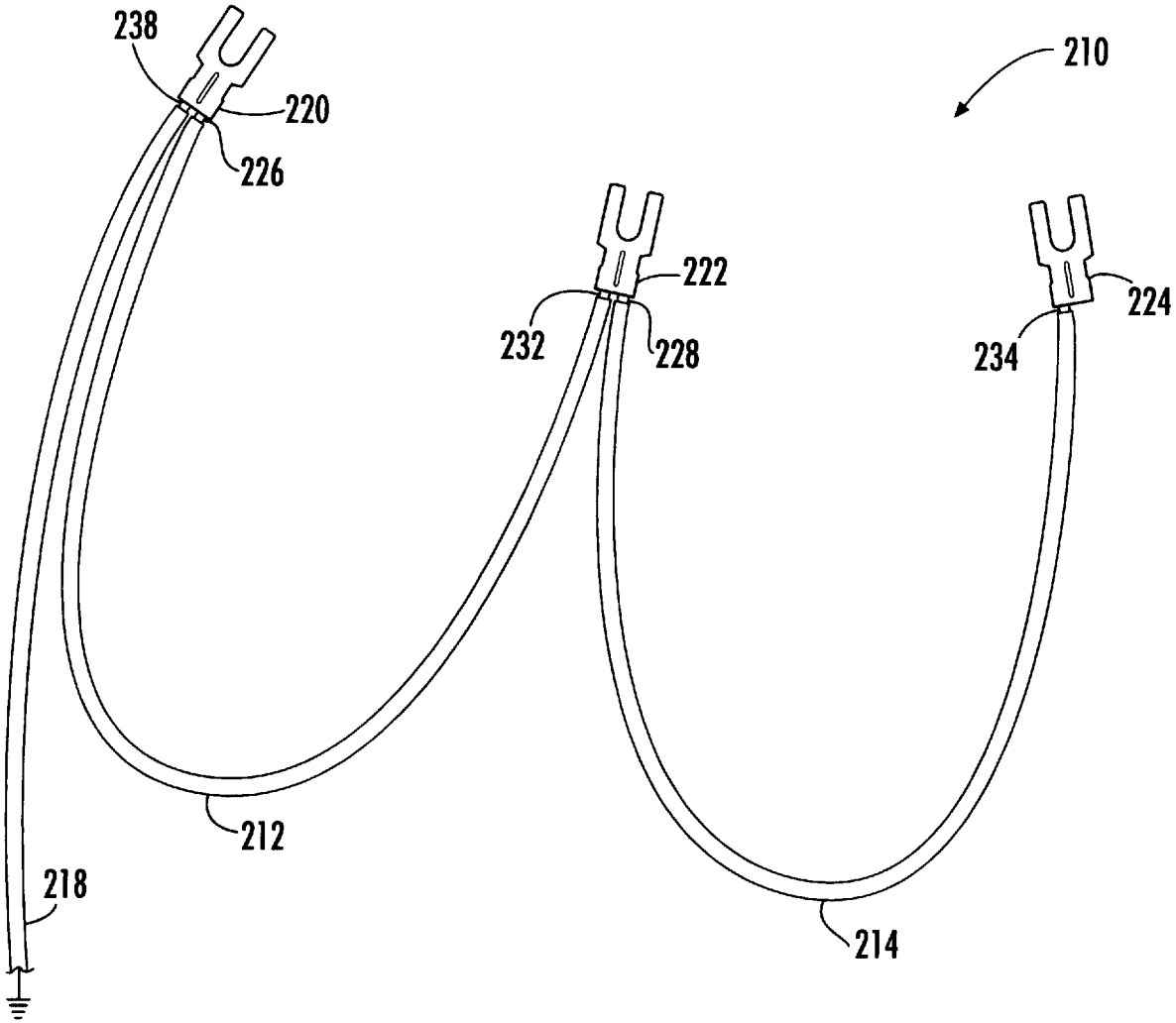
FIG. 6 is a plan view of the electrical conducting apparatus of the present invention.

In particular, the electrical conducting apparatus 210 itself is shown in FIG. 6 and includes two sheathed connecting wires 212,214, a sheathed lead grounding wire 218, and three crimped spade lugs 220,222,224. Each sheathed connecting wire 212,214 has a small diameter and is more malleable than solid copper wires 28,30,32 of the conventional switch apparatus 10.

Respective first ends 226,228 of the sheathed connecting wires 212,214 are retained within respective crimped spade lugs 220,222, and respective second ends 232,234 of the sheathed connecting wires 212,214 are retained within respective crimped spade lugs 222,224. The crimped spade lug 224 thereby connects together the sheathed connecting wires 212,214 in electrical communication with the plurality of sheathed connecting wires thereby forming an electrical network. Furthermore, the crimped spade lugs 222,224,226 are disposed in series relative to one another within the electrical network.

Crimped spade lug 220, while retaining a first end 226 of the sheathed connecting wire 212, further retains a first end 238 of the sheathed lead grounding wire 218. A second opposite end of the sheathed lead grounding wire 218 leads to the common ground, i.e., the ground wire nut 54 in the electrical switch apparatus shown in FIGS. 3 and 4. The sheathed lead grounding wire 218, disposed in electrical communication with the sheathed connecting wires 212,214, thereby grounds each respective grounding terminal 22,24, 26 of snap switches 14,16,18.

With the electrical conducting apparatus 210 of the present invention, when the snap switches 14,16,18 are installed in the wiring box 12 and the sheathed connecting wires 212,214 manipulated to permit positioning of the snap switches 14,16,18, the insulated sheath of each connecting wire 212,214 precludes inadvertent contact thereof with and grounding of any of the hot wires or hot terminals. Furthermore, the arrangement of the grounding terminals of the snap switches in series in the electrical network reduces the amount of connecting wire that must be disposed within the wiring box 12, especially when compared to the conventional electrical switch apparatus 10 wherein exposed solid copper wires 28,30,32 respectively connect each snap switch 14,16,18 to the ground wire nut 54.

The present invention is also not limited to an electrical switch apparatus having three snap switches. Rather, the electrical switch apparatus may include more than three snap switches, whereupon the preferred electrical conducting apparatus of the present invention would include an additional crimped spade lug and sheathed connecting wire for each additional snap switch. Conversely, the wiring box could include only two snap switches, whereupon the electrical conducting apparatus of the present invention preferably would include only two crimped spade lugs and one sheathed connecting wire. In either case, moreover, the electrical conducting apparatus would still include a sheathed lead grounding wire.

It will therefore be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to a preferred embodiment, it is to be understood that this disclosure is only illustrative and exemplary of the present invention and is made merely for purposes of providing a full and enabling disclosure of the invention. The foregoing disclosure is not intended nor to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for grounding a plurality of snap switches in a wiring box to a common ground source comprising the steps of:

connecting together the grounding terminal of each snap switch of the plurality of snap switches with sheathed connecting wires such that each grounding terminal of each snap switch of the plurality of snap switches is disposed in electrical communication only with the grounding terminal of each other snap switch of the plurality of snap switches, the electrical communication forming a closed electrical network; and, connecting with a sheathed lead grounding wire the closed electrical network to a common ground source of the wiring box such that each snap switch of the electrical network is grounded.

2. The method of claim 1, wherein said step of connecting the sheathed lead grounding wire comprises connecting the sheathed lead grounding wire to a grounding terminal of a snap switch of the plurality of snap switches.

3. The method of claim 1, wherein the electrical network is connected to the ground source only by the sheathed lead grounding wire.

4. The method of claim 1, wherein the grounding terminals of the snap switches are connected in series by the sheathed connecting wires.

5. An electrical switch apparatus, comprising:

a plurality of snap switches each including a grounding terminal;

a plurality of sheathed connecting wires, said grounding terminal of each said snap switch of said plurality of said snap switches being connected by at least one sheathed connecting wire of said plurality to a said grounding terminal of another said snap switch of said plurality such that all said grounding terminals of said snap switches are disposed in electrical connection only with each other through said sheathed connecting wires; and a sheathed lead grounding wire connecting one of said grounding terminal of one of said plurality of snap switches to a common ground source such that each said snap switch of said plurality is grounded.

6. The electrical switch apparatus of claim 5, wherein said grounding terminal of only one of said plurality of snap switches is connected to the common ground source by a sheathed lead grounding wire.

7. The electrical switch apparatus of claim 5, wherein said plurality of grounding terminals are connected in series with each other by said plurality of sheathed connecting wires.

8. The electrical switch apparatus of claim 5, wherein said sheathed connecting wires are secured to said grounding terminals of said snap switches by crimped spade lugs.

9. The electrical switch apparatus of claim 5, further comprising a wiring box to which said plurality of snap switches are mounted.

10. The electrical switch apparatus of claim 9, wherein said snap switches are mounted to said wiring box in series.

11. The electrical switch apparatus of claim 9, further comprising a wire nut to which at least one ground wire leading into the wiring box is connected, said wire nut comprising the common ground source.

12. An electrical conducting apparatus for connecting together a plurality of snap switches, comprising a plurality of sheathed connecting wires and a plurality of crimped spade lugs each configured for attachment to a grounding terminal of a snap switch, each end of each said sheathed connecting wire of said plurality of snap switches being retained within a said crimped spade lug such that said plurality of sheathed connecting wires are disposed in electrical connection with one another to form an electrical network, and a sheathed lead grounding wire having an end thereof retained within one of said crimped spade lugs and having an opposite end for connection to a common ground source.

13. The electrical conducting apparatus of claim 12, wherein said crimped spade lugs are disposed in series in said electrical network relative to one another.

* * * * *